US006597137B1

(12) United States Patent
Griepentrog et al.

(10) Patent No.: US 6,597,137 B1
(45) Date of Patent: Jul. 22, 2003

(54) METHOD AND DEVICE FOR TRANSMITTING AND RECEIVING A CONTROL SIGNAL TO A VEHICLE

(75) Inventors: Gerd Griepentrog, Gutenstetten (DE); Reinhard Maier, Herzogenaurach (DE); Peter Priebe, Wolfenbuettel (DE); Egid Schneider, Weisendorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/914,011

(22) PCT Filed: Feb. 22, 2000

(86) PCT No.: PCT/DE00/00557

§ 371 (c)(1),
(2), (4) Date: Aug. 22, 2001

(87) PCT Pub. No.: WO00/50286

PCT Pub. Date: Aug. 31, 2000

(30) Foreign Application Priority Data

Feb. 22, 1999 (DE) ..... 199 09 243

(51) Int. Cl.[7] ..... H02K 17/32; H02K 23/68; H02K 27/30; H02P 7/00; B61L 5/00

(52) U.S. Cl. ..... 318/434; 318/432; 340/310.01; 246/218; 246/219; 246/220; 246/221

(58) Field of Search ..... 318/434, 432; 340/310.01, 310.02, 538, 310.03; 246/194, 63 R, 62, 196, 218–221; 105/74; 104/77

(56) References Cited

U.S. PATENT DOCUMENTS

| | | | | | |
|---|---|---|---|---|---|
| 4,335,381 | A | * | 6/1982 | Palmer | 104/301 |
| 4,574,556 | A | * | 3/1986 | Schmidt et al. | 227/7 |
| 4,582,280 | A | * | 4/1986 | Nichols et al. | 105/61 |
| 5,251,856 | A | * | 10/1993 | Young et al. | 104/300 |
| 5,441,223 | A | * | 8/1995 | Young et al. | 104/300 |
| 5,586,736 | A | * | 12/1996 | Mollet | 246/194 |
| 5,628,478 | A | | 5/1997 | McConnel et al. | |
| 5,661,380 | A | * | 8/1997 | Obara et al. | 318/139 |
| 5,896,017 | A | * | 4/1999 | Severson et al. | 104/276 |
| 6,246,198 | B1 | * | 6/2001 | Makino et al. | 180/65.8 |
| 6,320,339 | B1 | * | 11/2001 | Lin et al. | 318/139 |

FOREIGN PATENT DOCUMENTS

DE 1 405 691 12/1961

OTHER PUBLICATIONS

Zitierte Entegenhaltungen aus dem Prufungsbescheid zur deutschen Prioritatsanmeldung Nr. 199 09 243.5, 30.6.28.

* cited by examiner

*Primary Examiner*—Robert E. Nappi
*Assistant Examiner*—Edgardo San Martin

(57) ABSTRACT

The invention relates to a method for transmitting a control signal to a vehicle which is driven using an electrical drive current which is fed into a traction current conductor at a drive current feed point. In order to ensure that the transmission of the control signal is very largely unaffected by interference frequency components included in the drive current, according to the invention one current sensor, which is located outside the line section, is used to receive the control signal.

9 Claims, 1 Drawing Sheet

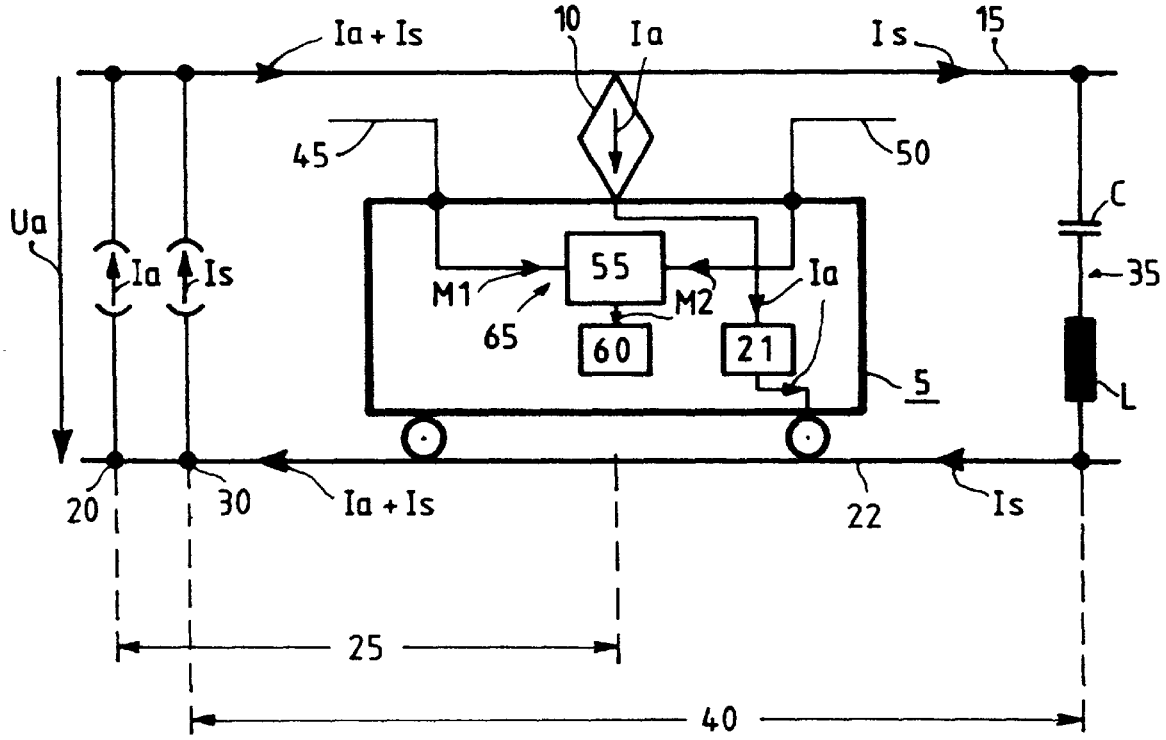
Ia + Is
10
Ia
Is
15
45
50
Ua
Ia
Is
55
M1
M2
Ia
65
60
21
5
C
35
L
20
30
Ia + Is
22
Is
25
40

METHOD AND DEVICE FOR TRANSMITTING AND RECEIVING A CONTROL SIGNAL TO A VEHICLE

This application claims priority to International Application No. PCT/DE00/00557 which was published in the German language on Feb. 22, 2000.

TECHNICAL FIELD OF THE INVENTION

The invention relates to a method and device for transmitting a control signal to a vehicle, and in particular, to a vehicle which is driven using an electrical drive current which is fed into a traction current conductor at a drive current feed point.

BACKGROUND OF THE INVENTION

German laid-open application 1 405 691 discloses a control signal which is fed, with commands or information for a rail vehicle, from a fixed command point into a contact wire as a traction current conductor. The electrical return flow of the control signal is ensured by the running rails and by suction circuits which are connected to the running rails and to the contact wire. The suction circuits are series resonant circuits which have low impedance for the control signals and high impedance for a drive current which is also transmitted via the contact wire. The drive current is used to drive the rail vehicle and is fed into the contact wire at a drive current feed point. The rail vehicle has a drive current collector via which the drive current flows into the rail vehicle. A line section is therefore formed by the drive current feed point and the position of the drive current collector. In order to receive the control signal, the rail vehicle is equipped with two current sensors, in the form of two coils, which are coupled inductively to the contact wire. One of the two current sensors is mounted at one end of the vehicle and the other of the two current sensors is mounted at the other end of the vehicle. As is also apparent from the laid-open application, both current sensors are used to receive the current signal.

SUMMARY OF THE INVENTION

In one embodiment of the invention, there is a method for transmitting a control signal to a vehicle which is driven using an electrical drive current for a drive motor comprising, feeding the control signal into a traction current conductor, the drive motor for the control signal having a high impedance such that the control signal flows away through the drive motor to a negligibly small degree; receiving the control signal at the vehicle using a current sensor which is inductively coupled to the traction current conductor; and providing a single current sensor, which is located outside a line section, to receive the control signal.

In one aspect of the invention, there is the control signal from the traction current conductor to a return conductor of the control signal via a low-impedance suction filter for the control signal, the suction filter arranged on the vehicle such that the current sensor is located spatially between a control signal feed point of the traction current conductor and the suction filter.

In another aspect of the invention, there is the control signal from the traction current conductor to a return conductor of the control signal via a low-impedance suction filter for the control signal, the suction filter is fixedly arranged in such that the current sensor is located spatially between a control signal feed point of the traction current conductor and the suction filter.

In still another aspect of the invention, there is a binary coded signal is transmitted as the control signal.

In yet another aspect of the invention, there is an FSK signal, an OFDM signal or a spread spectrum signal is transmitted as the binary coded signal.

In still another aspect of the invention, measuring the current in the traction current conductor using two current sensors which are arranged on each side of the drive current collector; and selecting the current measuring value of the current sensor which has the lower reception power to receive the control signal.

In one embodiment of the invention, there is a receiver device for a vehicle which has a drive current collector and a drive motor, the device receiving a control signal which is transmitted to the vehicle via a traction current conductor, the receiver device comprising, two current sensors which are coupled to the traction current conductor, one of which is arranged ahead of the drive current collector in the direction of travel and the other of which is arranged behind the drive current collector in the direction of travel; and a switching device which is connected to the two current sensors and the that current sensor which has the lower overall reception power to receive the control signal.

In one aspect of the invention, there is the traction current conductor is electrically connected to the vehicle by a drive current collector, where the drive current collector is in a position such that it forms a line section with a drive current feed point.

In another aspect of the invention, there is an FSK signal, an OFDM signal or a spread spectrum signal is transmitted as the binary coded signal.

In still another aspect of the invention, there is a binary coded signal is transmitted as the control signal.

BRIEF DESCRIPTION OF THE DRAWINGS

FIG. 1 illustrates an exemplary embodiment for a receiver device according to the invention.

DETAILED DESCRIPTION OF THE PREFERRED EMBODIMENTS

The invention relates to a method and device for transmitting a control signal to a vehicle, and in particular, to a vehicle which is driven using an electrical drive current which is fed into a traction current conductor at a drive current feed point. The vehicle is electrically connected to the traction current conductor by means of a drive current collector, in such a position that the drive current collector forms, together with the drive current feed point, a line section, in which method the control signal is fed into the traction current conductor and the control signal is received at the vehicle end using a current sensor which is inductively coupled to the traction current conductor.

The invention discloses a method wherein the transmission of a control signal to the vehicle is largely unaffected by interference frequency components contained in the drive current.

The invention includes one current sensor, which is located outside the line section, to receive the control signal.

A significant advantage of the method according to the invention is that one current sensor, which is located outside the line section, is used to receive the control signal. Using one current sensor located outside the line section ensures that the control signal is received without interference. This fact can be explained as follows: during the transmission of the drive current from the drive current feed point to the drive current collector, sparks are occasionally formed or arcs generated by the drive current collector, causing high-frequency interference currents to be generated in the traction current conductor. These interference currents flow from the drive current feed point to the drive current collector of the vehicle, and subsequently back to the drive current feed point via a return conductor, for example rails in rail-bound vehicles. This results in high-frequency interference currents applied to the line section which is bounded by the drive current feed point and the drive current collector. Therefore, if one current sensor, which is located outside this line section, is used to receive the control signal, the control signal which is not subject to interference is measured with the current sensor, and neither the drive current nor the high-frequency interference currents contained in the drive current are measured.

In order to ensure reliable inductive transmission of the control signal to the vehicle, a sufficiently large control signal current needs to flow through the traction current conductor. This can be achieved by transmitting the control signal from the traction current conductor to a return conductor of the control signal via a low-impedance suction filter for the control signal, which suction filter is arranged on the vehicle in such a way that the current sensor is located spatially between a control signal feed point of the traction current conductor and the suction filter. Vehicle-mounted suction filters which have low impedance for control signals are known from German patent 538 650.

In order to ensure reliable inductive transmission, another embodiment of the invention discloses a method for the control signal to be transmitted from the traction current conductor to a return conductor of the control signal via a low-impedance suction filter for the control signal, which suction filter is fixedly arranged, in the case of rail vehicles, for example, on the track, in such a way that the current sensor is located spatially between a control signal feed point of the traction current conductor and the suction filter.

The control signal can be transmitted reliably to the vehicle if a binary coded signal is transmitted as the control signal because binary coded signals make it possible to use additional check bits with which the received control signal can be tested in the vehicle for transmission errors.

The control signal can be transmitted advantageously if an FSK (Frequency Shift Keying) signal, an OFDM (Orthogonal Frequency Division Multiplexing) signal or a spread spectrum signal is transmitted as the binary coded signal.

The invention also relates to a receiver device for receiving a control signal for a vehicle which has a drive current collector and two current sensors which are arranged on each side of the drive current collector.

A receiver device wherein the transmission of a control signal is not affected by interference frequency components contained in the drive current is proposed according to the invention. This receiver device according to the invention is distinguished in that it has a switching device which, for the reception of the control signal, selects that current sensor of the two current sensors which has the lower reception power.

An advantage of the arrangement according to the invention is that the switching device ensures that, while the vehicle is operated, the control signal is received exclusively with the current sensor which is located outside the line section determined by the drive current feed point and the position of the drive current collector. This is because the switching device activates that current sensor which has a lower overall reception power, to receive the control signal.

As has already been explained in conjunction with the method according to the invention, both the control signal current and the drive current with its high-frequency interference components flow via the part of the traction current conductor located in the line section, with the result that the current sensor located in the line section has a significantly greater overall reception power than that current sensor which is located outside this line section, because the control signal current flows in the traction current conductor outside the line section. The switching device in the receiver device according to the invention therefore selects that current sensor with which the receiving signal can be received more reliably because the selected current sensor does not have its own drive current applied to it, and therefore does not have the interference current contained in its own drive current applied to it.

FIG. 1 shows a rail vehicle 5 which is connected with a drive current collector 10 to a contact wire 15 as traction current conductor. A drive voltage Ua is applied to the contact wire 15 at a drive current feed point 20, by means of which drive voltage Ua a drive current Ia flows through the contact wire 15, the drive current collector 10 and a drive motor 21 of the rail vehicle 5. The return flow of the drive current Ia is ensured by rails 22 on which the rail vehicle 5 travels. The drive current feed point 20 and the drive current collector 10 or its position define a line section 25.

A control signal in the form of a control signal current Is is fed into the contact wire 15 at a control signal feed point 30. The control signal current Is passes to the rail vehicle 5 and to a suction filter 35 which is formed by a series resonant circuit with a capacitor C and an inductor L, and which, together with the control signal feed point 30, defines a further line section 40. The return flow of the control signal or the control signal current Is is ensured by the rails 22. In this further line section 40, the control signal or the control signal current Is is therefore transmitted via the contact wire 15. The rail vehicle 5 has two current sensors 45 and 50 in the form of antennas which are embodied, for example, as coils and which are coupled inductively to the contact wire 15 at a distance of, for example, approximately 0.5 m. One of the two current sensors 45 is located in the one line section 25 while the other of the two current sensors 50 is located outside this line section 25. The two current sensors 45 and 50 are used to determine current measuring values which indicate the current flowing through the contact wire 15 at the respective current sensor point. The current measuring value M1 of the current sensor 45 therefore gives the current Ia+Is in the contact wire 15, and the current measuring value M2 gives the current measuring value Is in the contact wire 15. It is assumed that the drive motor 21 has such a high impedance for the control current Is, whether independently or as a result of appropriately embodied operating current filter circuits which are assigned to the drive motor 21, that the control current Is flows away through the drive motor 21 to a negligibly small degree. The two current measuring values M1 and M2 are each fed to an input of a switching device 55, downstream of which a control signal evaluation device 60 is arranged on the output side. The switching device 55 and the control signal evaluation device 60 and the two current sensors 45 and 50 form a receiver device 65 for the rail vehicle 5, for receiving the control signal and the control current Is.

The two current measuring values M1 and M2 are compared in the switching device 55 in terms of their reception power. In this process it is ensured that the reception power P1 of the current sensor 45 is significantly greater than the reception power P2 of the current sensor 50; this is because the following applies:

$$P1 \sim (Ia+Is)^2 >> P2 \sim Is^2$$

because the drive current Ia is significantly greater than the control signal current Is.

The switching device 55 then selects the current sensor 50 to receive the control current Is because the current measuring value M2 of the current sensor 50 is free of the drive current Ia, and thus free of high-frequency interference currents contained in the drive current Ia, and transmits the current measuring value M2 to the control signal evaluation device 60 in which the control signal or the control signal current Is is evaluated.

In the arrangement according to FIG. 1, the suction filter 35 is mounted on the line between the contact wire 15 and the rails 22. Alternatively, the suction filter 35 can be mounted on the rail vehicle. The electrical contact with the contact wire 15 is to be ensured in such a case by, for example, an additional current collector which is to be arranged on the vehicle in such a way that the current sensor 50 which is suitable for receiving the control signal or control current Is is located spatially between the control signal feed point 30 and the suction filter.

In the exemplary embodiment described in conjunction with FIG. 1, the current sensors 45 and 50 are provided, and the current measuring values M1 and M2 for the switching device 55 are measured with said current sensors 45 and 50. With an appropriately configured switching device 55 it is also possible to use, instead of the current sensors 45 and 50, current sensors of some other type, namely ones with which in each case current measuring variables or voltage measuring variables which are proportional to the current flowing at the respective point in the contact wire 15 are formed for the switching device 55.

In summary, therefore, a method for transmitting a control signal to an electrically driven vehicle is thus described in which the transmission of the control signal to the vehicle is unaffected by interference frequency components contained in the drive current of this vehicle.

It is then possible to transmit, for example, a binary coded signal, preferably an FSK (Frequency Shift Keying) signal, an OFDM (Orthogonal Frequency Division Multiplexing) signal or a spread spectrum signal as the control signal or control current Is.

The method according to the invention can be advantageously used in rail vehicles, trolleybuses, cable railroads, suspended railroads or other vehicles which are driven electrically via a traction current conductor. The traction current conductor can be a contact wire (for example overhead line in the case of rail vehicles) or as a current rail or the like.

What is claimed is:

1. A method for transmitting a control signal to a vehicle which is driven using an electrical drive current for a drive motor which is fed into a traction current at a drive current feed point, the vehicle electrically connected to the traction current by a drive current collector, such that the drive current collector forms, with the drive current feed point, a line section, comprising:

feeding the control signal into the traction current conductor;

receiving the control signal at the vehicle using a current sensor which is inductively coupled to the traction current conductor; and providing a single current sensor, which is located outside the line section, to receive the control signal.

2. The method as claimed in claim 1, further comprising:

transmitting the control signal from the traction current conductor to a return conductor of the control signal via a low-impedance suction filter for the control signal, the suction filter arranged on the vehicle such that the current sensor is located spatially between a control signal feed point of the traction current conductor and the suction filter.

3. The method as claimed in claim 1, further comprising:

transmitting the control signal from the traction current conductor to a return conductor of the control signal via a low-impedance suction filter for the control signal, the suction filter is fixedly arranged in such that the current sensor is located spatially between a control signal feed point of the traction current conductor and the suction filter.

4. The method as claimed in claim 2, wherein a binary coded signal is transmitted as the control signal.

5. The method as claimed in claim 4, wherein an FSK signal, an OFDM signal or a spread spectrum signal is transmitted as the binary coded signal.

6. The method as claimed in claim 1, further comprising:

measuring the current in the traction current conductor using two current sensors which are arranged on each side of the drive current collector; and selecting the current measuring value of the current sensor which has the lower reception power to receive the control signal.

7. A receiver device for a vehicle which has a drive current collector and a drive motor, the device receiving a control signal which is transmitted to the vehicle via a traction current conductor, the receiver device comprising:

two current sensors which are coupled to the traction current conductor, one of which is arranged ahead of the drive current collector in the direction of travel and the other of which is arranged behind the drive current collector in the direction of travel; and a switching device which is connected to the two current sensors and selects the current sensor which has the lower overall reception power to receive the control signal.

8. The method as claimed in claim 3, wherein a binary coded signal is transmitted as the control signal.

9. The method as claimed in claim 8, wherein an FSK signal, an OFDM signal or a spread spectrum signal is transmitted as the binary coded signal.

* * * * *